US005142100A

United States Patent [19]

Vaupotic

[11] Patent Number: 5,142,100

[45] Date of Patent: Aug. 25, 1992

[54] TRANSMISSION LINE WITH FLUID-PERMEABLE JACKET

[75] Inventor: Gregory P. Vaupotic, Portland, Oreg.

[73] Assignee: SuperComputer Systems Limited Partnership, Eau Claire, Wis.

[21] Appl. No.: 694,467

[22] Filed: May 1, 1991

[51] Int. Cl.[5] ..... H01B 11/06; H01B 7/34

[52] U.S. Cl. ..... 174/24; 29/857; 156/53; 156/56; 174/25 R; 174/27; 174/34; 174/36; 174/120 R

[58] Field of Search ..... 174/24, 27, 25 R, 36, 174/34, 120 R; 156/53, 56; 29/857

[56] References Cited

U.S. PATENT DOCUMENTS

| | | | |
|---|---|---|---|
| 1,282,208 | 10/1918 | Fisher | 174/24 |
| 2,691,698 | 10/1954 | Schmidt | 174/36 |
| 3,634,597 | 11/1972 | Ziemek et al. | 174/15.6 |
| 3,742,116 | 6/1973 | Aupoix et al. | 174/34 |
| 3,984,618 | 10/1976 | Schmidt | 174/15.5 |
| 4,031,310 | 6/1977 | Jachimowicz | 174/15.5 |
| 4,088,830 | 5/1978 | Wargin et al. | 174/113 R |
| 4,336,420 | 6/1982 | Benz | 174/128 S |
| 4,472,598 | 9/1984 | Boyd et al. | 174/113 R |
| 4,492,089 | 1/1985 | Rohner et al. | 62/55 |
| 4,508,934 | 4/1985 | Feldman, Jr. | 174/101.5 |
| 4,510,346 | 4/1985 | Bursh, Jr. et al. | 174/36 |
| 4,607,133 | 8/1986 | Alloin et al. | 174/15.7 |
| 4,647,712 | 3/1987 | Alloin et al. | 174/15.7 |
| 4,731,134 | 3/1988 | Alloin et al. | 156/53 |
| 4,966,886 | 10/1990 | Hoshiko | 505/1 |
| 5,015,800 | 5/1991 | Vaupotic et al. | 174/34 |
| 5,037,999 | 8/1991 | Van Deusen | 174/36 |

FOREIGN PATENT DOCUMENTS

| | | | |
|---|---|---|---|
| 815207 | 10/1951 | Fed. Rep. of Germany | 174/34 |
| 2225457 | 12/1973 | Fed. Rep. of Germany | 174/34 |
| 3123040 | 1/1983 | Fed. Rep. of Germany | 174/36 |
| 1440850 | 4/1986 | France . | |
| 264112 | 10/1989 | Japan . | |
| 551450 | 2/1943 | United Kingdom | 174/120 R |

*Primary Examiner*—Morris H. Nimmo

*Attorney, Agent, or Firm*—Chernoff, Vilhauer, McClung & Stenzel

[57] ABSTRACT

A structure for an electrical cable which may be used as a high-frequency signal transmission line and which includes a jacket which is highly permeable by fluids to reduce the time required for stabilization of impedance and transmission speed of the cable upon placement into an environment characterized by a fluid dielectric having a different dielectric constant. The permeable jacket also facilitates electrical connection to a shield conductor of the transmission line, exposed through apertures in the jacket, by use of electrically conductive potting materials, and without the need to remove any portions of the jacket surrounding the shield conductor to which electrical connection is to be made.

10 Claims, 5 Drawing Sheets

TRANSMISSION LINE WITH FLUID-PERMEABLE JACKET

BACKGROUND OF THE INVENTION

The present invention relates to electrical signal-carrying cables, and particularly to controlled-impedance cables which may be immersed in fluids having dielectric constants different from that of air, and which may include shield conductors.

A significant problem in the use of signal transmission lines in the form of coaxial cables or jacketed or shielded insulated sets of conductors in applications where the characteristic impedance and signal transmission speed are critical is that a change in the dielectric constant and thus the characteristic impedance and transmission speed of the transmission line occurs if the transmission line is immersed in a fluid other than air, such as a coolant. In some applications of transmission lines a coolant is necessary because of the amount of power dissipated during operation, but the change in impedance and speed of such transmission lines which occurs as a result of immersion of the transmission lines in a coolant is so significant that some devices, such as computers, in which the transmission lines are used cannot be operated or even tested after immersion in the coolant until the change in impedance and speed of the transmission line has occurred and conditions have become stabilized.

It is therefore important for transmission lines to be used in such applications to become stabilized as rapidly as possible, in order for testing to be accomplished after repairs have been made. Extruded jackets for transmission lines require at least several hours to provide for replacement of air found in the interstices within the jackets, between the conductors and between the conductors and jacket elements of such transmission lines. In the case of very large computers the value of time lost waiting for stabilization of transmission lines can be tremendous.

One solution to this problem has been the use of some types of expanded polytetrafluoroethylene (PTFE) as the material for the jacket layer surrounding the conductors of such a transmission line. The porosity of such expanded PTFE permits a rather rapid entry of coolant fluid to displace the air otherwise contained within the jacket when the transmission line is not immersed in a cooling fluid.

While such construction of transmission lines enhances the stabilization of impedance in response to immersion of the transmission line in a cooling fluid having a different dielectric constant than that of air, electrical connection to the shield conductor of such transmission lines has previously required that the shield conductor be uncovered to provide a location for interconnection of the shield conductor to a ground lead or to another conductor which forms part of an electrical circuit incorporating the transmission line.

What is needed, then, is an improved structure for an electrical cable, and particularly for a high-speed signal transmission line, which permits rapid infiltration of a dielectric fluid into the interior of such an electrical cable, so that changing impedance and speed resulting from immersion of the cable into a fluid such as a coolant will not unduly delay testing and operation. It is also desired to have such a transmission line or similar electrical cable which can be connected more easily and quickly than has previously been possible.

SUMMARY OF THE INVENTION

The present invention supplies an answer to the aforementioned need for an improved signal transmission line or cable by providing such a transmission line or cable including a jacket layer applied as a helical wrapping with a great enough spacing, longitudinally of the cable, between adjacent turns of a helically-applied elongate member to permit a fluid to flow quickly through the jacket and permeate the interior of the transmission line or cable to displace other fluids in a short time.

In a preferred embodiment of the invention a twisted pair of conductors, each covered by a layer of a dielectric material, are covered by a helically-wrapped shield conductor, which may be of an aluminized plastic tape wrapped with a small amount of overlap. A preferred embodiment of a jacket according to the present invention is in the form of two layers of dielectric tape, wrapped helically in opposing directions. Longitudinally adjacent helical turns of tape forming each layer of the jacket are spaced apart from one another so that apertures are defined in the jacket, through which a fluid may pass into contact with the shield and thence through the shield to replace air inside the shield layer.

In a preferred embodiment of the invention a shield conductor layer is formed with an electrically conductive layer outermost, so that the electrically conductive layer is exposed through the apertures defined by the jacket, and electrical contact may be effected with the shield layer without removal of the jacket, thus permitting connection of the shield to another conductor by the use of an electrically conductive potting material surrounding the cable, either near an end or at any other point along the length of the cable, as desired.

It is therefore an important object of the present invention to provide an improved electrical signal transmission line structure.

It is another important object of the present invention to provide an electrical signal transmission line capable of rapidly achieving stability when placed into an environment containing a different fluid dielectric material surrounding the transmission line.

It is a further object of the present invention to provide an improved signal transmission line facilitating electrical connection to a shield conductor enclosed by a jacket according to the present invention, and a method for accomplishing such connection.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
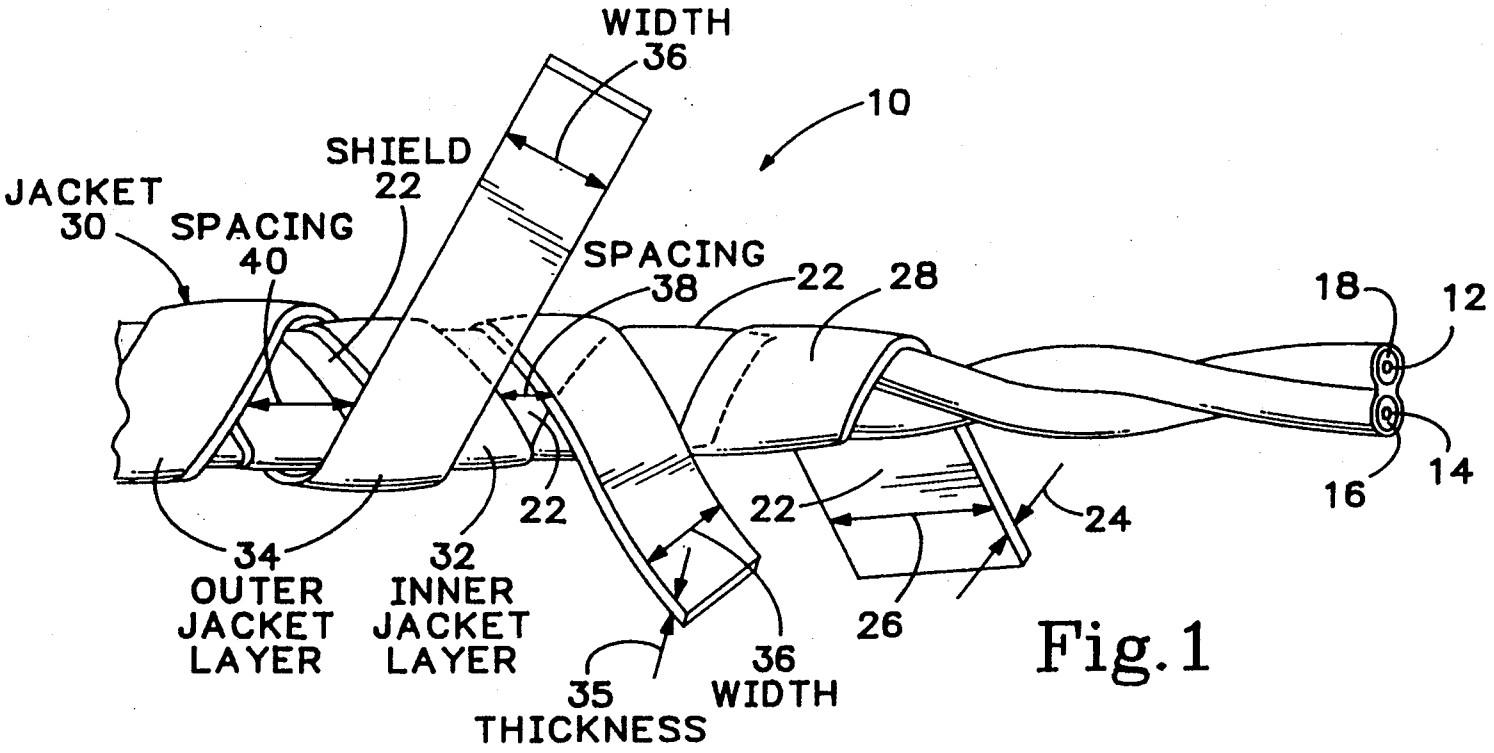
FIG. 1 is a perspective view of a length of cable according to the present invention including a twisted pair of primary conductors, a shield, and a jacket constructed in accordance with the present invention, shown partially unwrapped for clarity.
Figure 2:
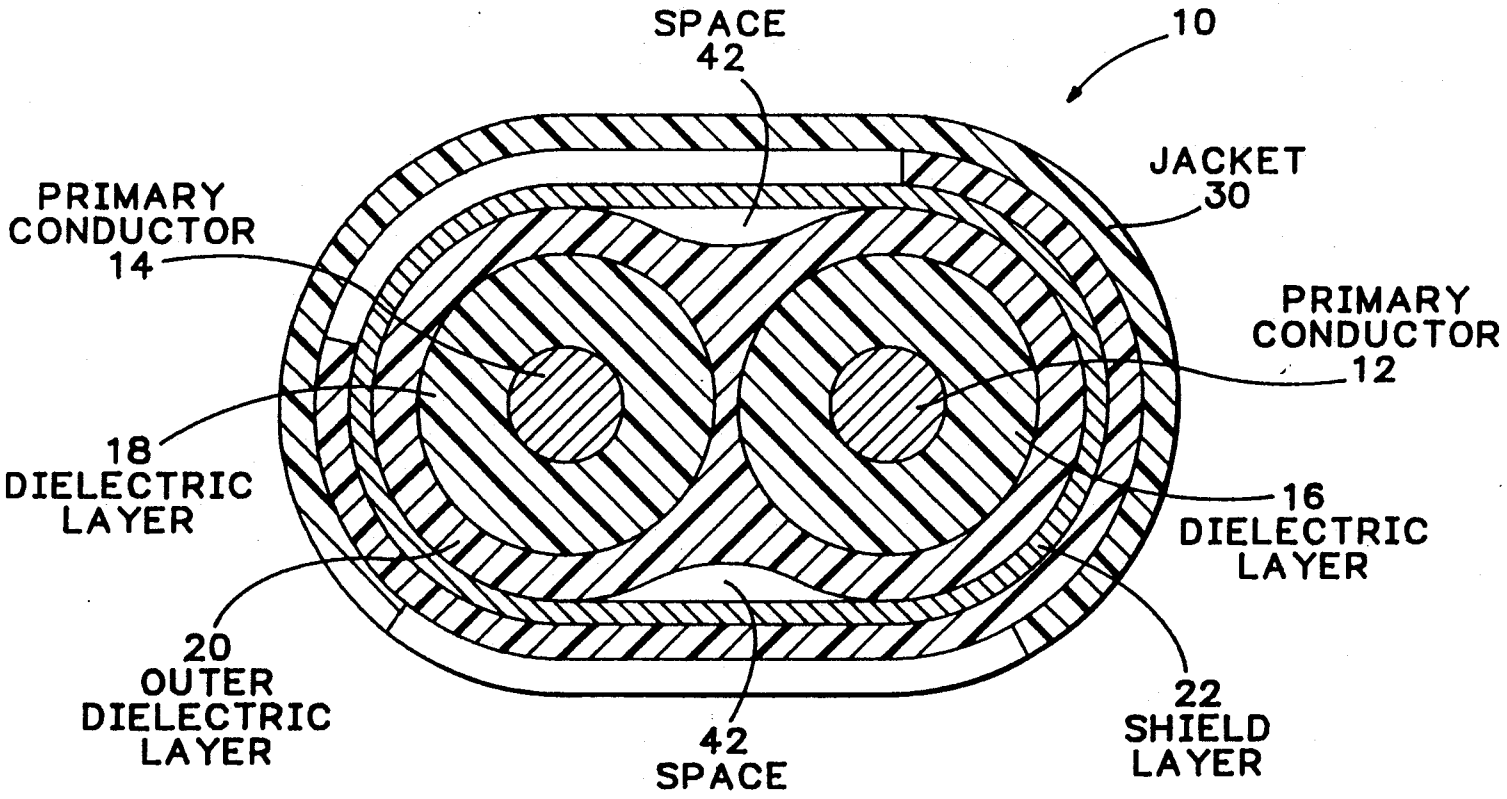
FIG. 2 is a cross section view of the cable shown in FIG. 1.

Referring now to the drawings which form a part of the disclosure herein, and particularly to FIGS. 1 and 2, a cable 10 includes a pair of primary conductors 12 and 14, which may, for example, be of 36 AWG silver plated copper alloy. The primary conductors 12 and 14 are covered by respective insulating layers 16, 18 of a dielectric material which may be of an extruded, generally non-porous form, or which may be one of various cellular (foamed) or air-enhanced dielectric materials. Preferably an outer layer 20 of dielectric material covers both of the primary conductors 12 and 14, together with their respective dielectric layers 16 and 18, retaining them closely in proximity with each other, and the primary conductors 12 and 14 are helically twisted, as is explained more fully in Vaupotic et al., U.S. Pat. No. 5,015,800, issued May 14, 1991, of which the disclosure is included herein by reference.

For example, each dielectric layer 16, 18, may be of an extruded polymeric fluorocarbon such as TEFLON® fluorinated ethylene propylene (FEP), with a nominal wall thickness of 0.005 inch, and the outer dielectric layer 20 may preferably be of a polyolefin having a nominal wall thickness of about 0.0025 inch, applied to hold together the primary conductors 12 and 14 and their associated layers 16 and 18 of dielectric.

Similarly, three, four, or a larger number of conductors could be included, each separately provided with layers of dielectric material.

A shield conductor 22 surrounds the twisted pair (or greater number, not shown) of primary conductors 12, 14 and their respective layers of insulating dielectric materials, and may be in the form of a helical wrapping of a foil tape, laid in the direction opposite from that of the twist of the pair of primary conductors 12, 14. The shield 22 for the cable 10 may be, for example, a commercially available foil tape of aluminum supported by a polyester film, having a total thickness 24 of about 0.001 inch and a width 26 of about 1/16th inch. Other materials may also be used, such as a plastic material permeated with suitable electrically conductive material. The shield 22 is preferably wrapped with the conductive layer of aluminum facing outward as the exterior surface 28 of the shield layer 22, and with a small overlap, for example, about 10%, providing uniformity of the characteristic conductivity or impedance of the cable 10, but without unduly inhibiting flow of fluid through the overlapping areas. There is no adhesive bonding of the tape of the shield conductor 22, either to itself or to the outer dielectric layer 20 surrounding the primary conductors 12, 14, in order to enable fluids to penetrate within the shield conductor 22 through the interstices between the overlapping helical wraps, or turns, of foil tape. The shield 22 could also be provided in the form of a braided shield (not shown), a serving of several parallel wires (not shown) or as a foil ribbon extending essentially longitudinally of the cable and having a width slightly greater than the circumference of the dielectric layer 22, and wrapped about the conductors 12, 14 and the layers 16, 18, and 20 of the dielectric material (also not shown).

Overlying the shield layer 22 is a jacket 30 consisting of two layers of a dielectric material such as polytetrafluoroethylene (PTFE) in the form of two elongate tapes wrapped helically over the shield 22, in opposite directions. An inner layer 32 is thus wrapped in a helical fashion opposite the lay of the shield layer 22, and an outer layer 34 is wrapped in the same direction as the lay of the shield layer 22.

For example, both the inner layer 32 and the outer layer 34 are of PTFE tape having a thickness 35 of about 0.002 inch and a width 36 of about 1/16th inch, although the width 36 is not critical. It is of vital importance to the present invention, however, that both the inner layer 32 and the outer layer 34 are wrapped with such a pitch that the edges of adjacent turns of the helical wrapping of each layer are separated longitudinally along the cable 10, to provide definite spacings 38, 40. As a result, quadrilateral portions of the shield 22 remain exposed between the overlapping, oppositely-wrapped, turns of the tape forming the inner layer 32 and outer layer 34 of the jacket 30. Thus, the shield 22 is exposed to fluids into which the cable 10 may be immersed, such as a cooling flow of a fluorocarbon liquid, for example, the dielectric coolant Fluorinert® available from the 3M Company of Minneapolis, Minn., so that the fluid can quickly permeate the interior of the cable 10, displacing air from the spaces 42 and similar spaces surrounding the insulating dielectric layers, 16, 18, and 20. This enables the cable to quickly become stabilized with the dielectric characteristics imposed upon it as by a fluid cooling bath, as when the cable 10 is used in an environment where heat must be dissipated.

While additional time is required for such a cable to become fully saturated by a dielectric fluid, as by penetration of the dielectric fluid of such a cooling bath into the dielectric layers 16, 18, and 20, which requires a considerably longer time, the most significant portion of the change in the dielectric characteristic of the cable 10 occurs within a few minutes after the cable 10 is first immersed into a fluid dielectric taking the place of air.

Figure 3:
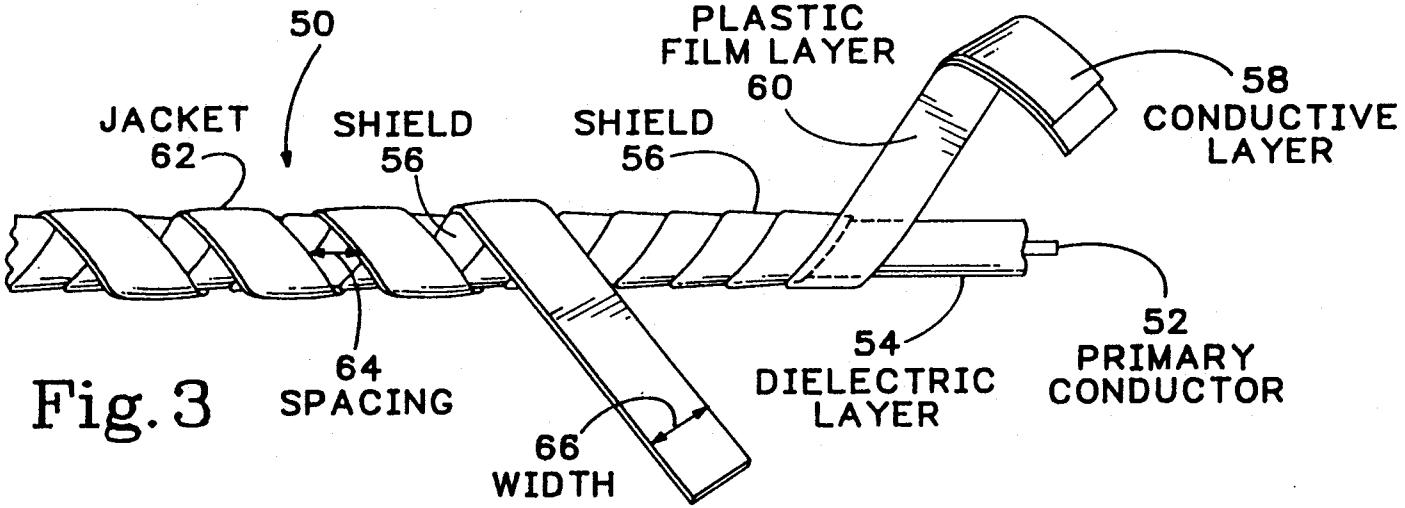
FIG. 3 is a view of a cable including a central conductor, a shield conductor, and a jacket according to the present invention, shown partially unwrapped for clarity.
Figure 4:
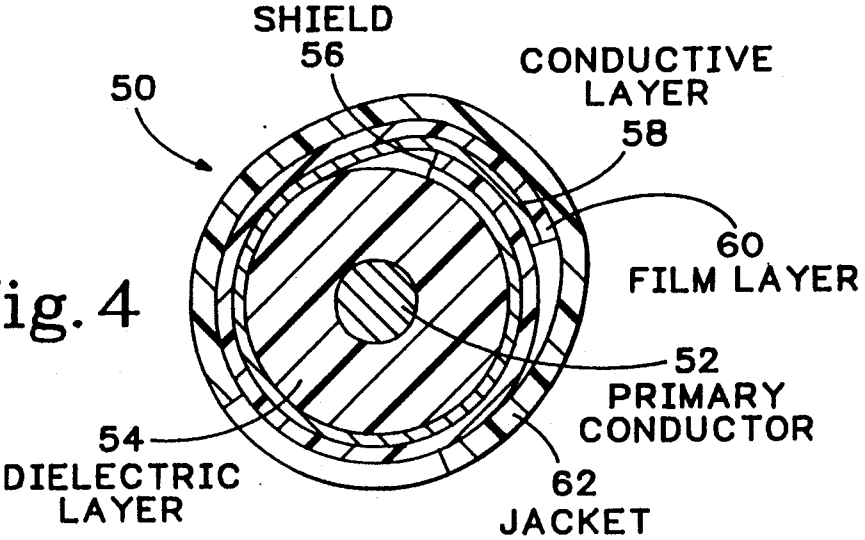
FIG. 4 is a sectional view of the cable shown in FIG. 3.

Referring next to FIGS. 3 and 4, a coaxial cable 50 includes a central, or primary, conductor 52, surrounded by a layer 54 of dielectric material. The dielectric layer 54 may, for example be of a suitable fluorocarbon or polyolefin dielectric material, which may be similar to the materials of the dielectric layers 16, 18, and 20 described above. Wrapped helically about the dielectric layer 54 is an outer, or shield conductor 56, in the form of a tape having a pair of layers adhesively bonded to one another in a well-known manner. For example, a conductive inner layer 58 of aluminum foil, is supported by a layer 60 of a dielectric film of, for example, a polyester plastic, the two layers together forming a thin, narrow tape wrapped helically about the dielectric layer 54 with a uniform, preferably small, overlap of, for example, about 10%, which leaves the supportive plastic film layer 60 facing outward as an exterior surface of the shield conductor 56. The several turns of the shield 56 are not adhesively bonded to one another, thus leaving a path for fluid to enter the interior of the cable 50.

A jacket 62 surrounds the shield 56 and supports it mechanically, keeping the shield 56 closely associated with the central conductor 52 and its dielectric layer 54. However, the jacket 62 leaves portions of the shield 56 exposed, providing access for fluids to enter through the jacket 62 to proceed between the overlapping turns of the helically wrapped tape forming the shield 56. The jacket 62 is fashioned as an elongate tape of a dielectric material wrapped in successive helical turns over the shield 56, but in the opposite direction, and, importantly, with adjacent turns separated from each other longitudinally of the cable 50 by a spacing 64, preferably less than the width 66 of the dielectric tape of which the jacket 62 is made.

The jacket 62 is adhered to the shield 56 in a manner depending upon the materials of which the shield 56 and the jacket 62 are made. For example, if the plastic film layer 60 is of a polyester plastic, the jacket 62 may also be of a polyester plastic tape carrying a layer of heat-sealable polyester adhesive. Thus, the jacket 62 may be wrapped around the shield 56 and fastened by passing the cable 52 through an oven to provide the required amount of heat to bond the jacket 62 to the shield 56.

It would also be possible to bond a jacket 62 of polyester to a polyester film layer 60 of the shield 56 using a suitable solvent adhesive, assuming that the dielectric layer 56 is of a material which would not be adversely affected by the solvent necessary to bond the jacket 62 to the shield 56. Alternatively, the plastic film layer 60 may be of a PTFE material, in which case the jacket 62 may also be of a PTFE tape, and the jacket 62 will then adhere sufficiently to the shield 56 without the addition of any adhesive material.

Figure 5:
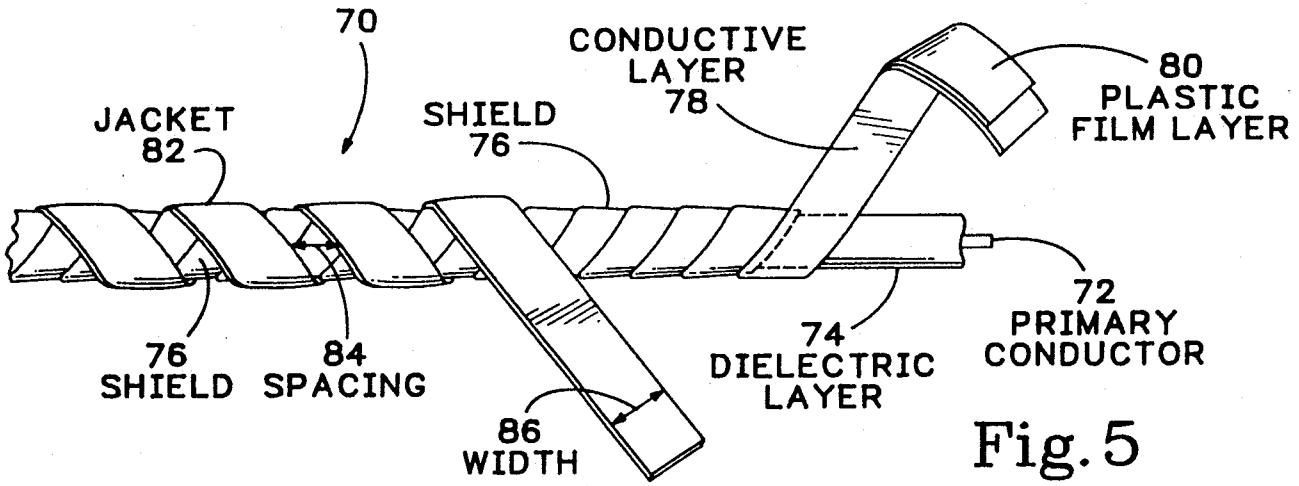
FIG. 5 is a view of a coaxial cable which is a further embodiment of the present invention, also shown partially unwrapped.
Figure 6:
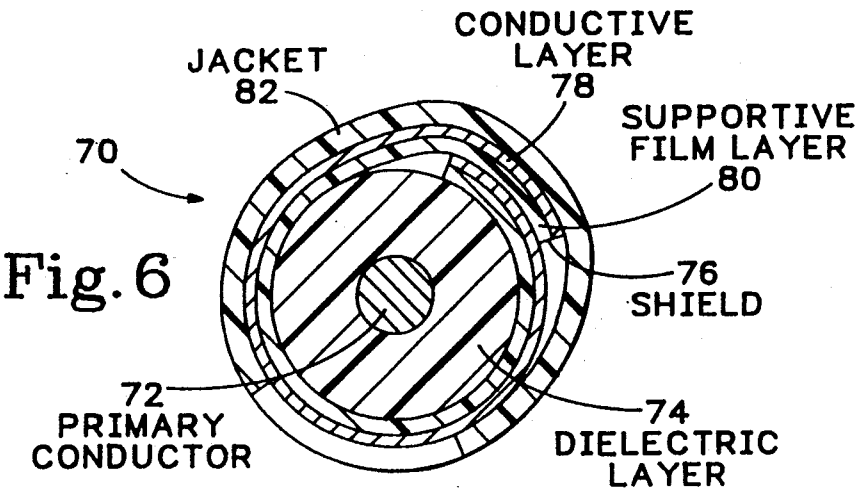
FIG. 6 is a sectional view of the cable shown in FIG. 5.

A cable 70, shown in FIGS. 5 and 6 is generally similar to the cable 50, having a primary conductor 72 similar to the primary conductor 52, a dielectric layer 74 similar to the dielectric layer 54, and a shield layer 76 made of a flexible dielectric tape with a coating or layer of conductive material attached, or with conductive material permeating the support of plastic layer. Thus, as shown in FIGS. 5 and 6, a conductive layer 78 may be bonded to a polyester plastic film layer 80, and the shield layer 76 of a tape so constructed is wrapped helically about the dielectric layer 74, but with the conductive layer 78 exposed outwardly and the plastic film layer 80 being inwardly exposed toward the dielectric layer 74.

A jacket 82 surrounds and provides mechanical support for the shield 76 and is similar to the jacket 62 described in connection with the cable 50, with adjacent turns of the helically wrapped tape of the jacket 62 providing a spacing 84 between adjacent turns of the material of the jacket 82. As with the cable 50, the spacing 84 is preferably smaller than the width 86 of the tape of the jacket 82, in order that ample mechanical support be available for the shield layer 76.

Figure 7:
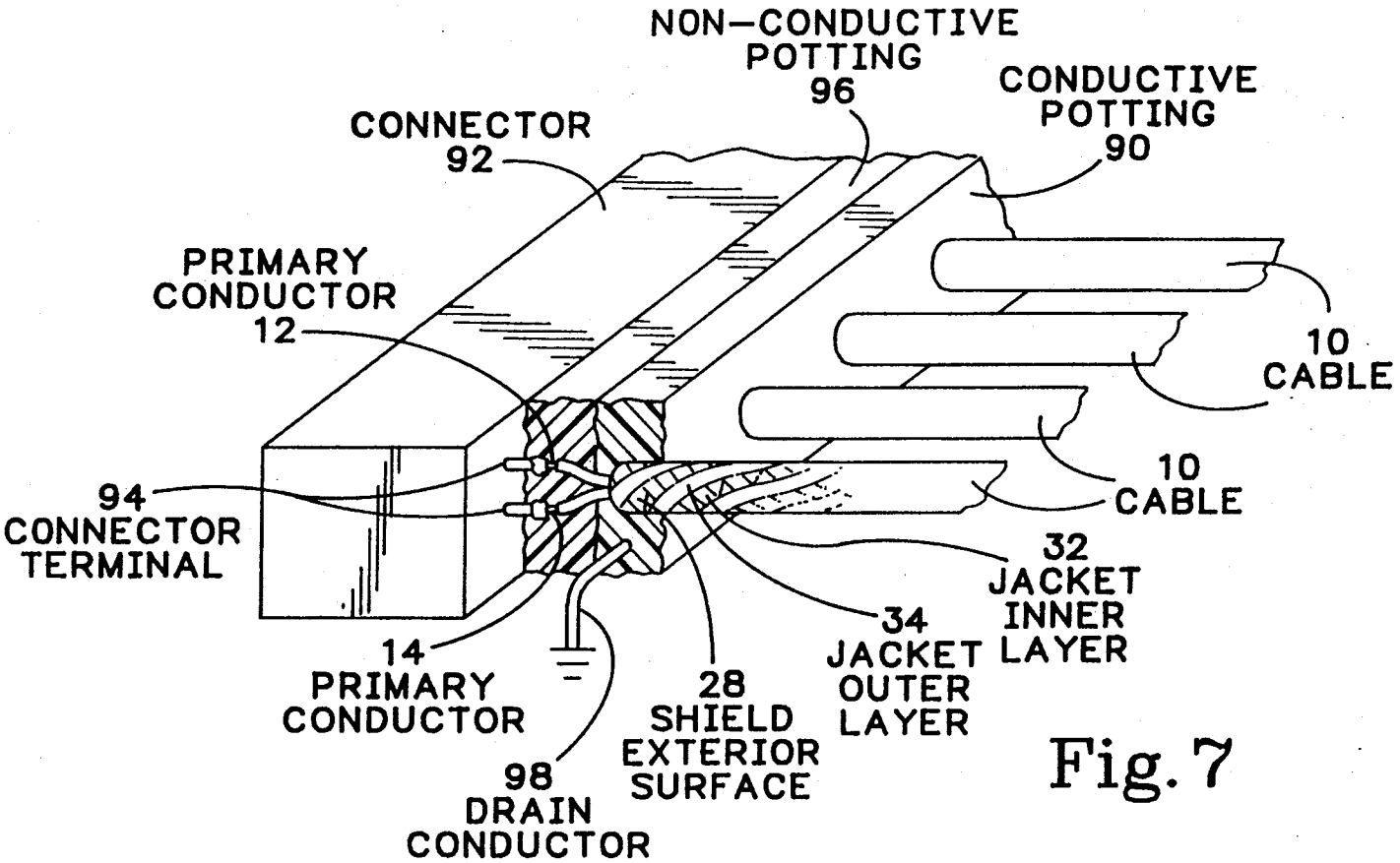
FIG. 7 is a partially cut-away view showing connection of several cables such as the one shown in FIGS. 1 and 2 to a connector, in accordance with the present invention.

In addition to the ability to be permeated quickly by a fluid which might affect the dielectric characteristics of a cable, the construction of the cable 10 shown in FIGS. 1 and 2, and similarly, the construction of the cable 70 shown in FIGS. 5 and 6, makes it possible to terminate a cable constructed in accordance with the present invention much more economically than has previously been possible, since the shield conductor 22 is accessible through the jacket. As an important result, connection of the shield 22 into a circuit incorporating the cable 10 can be accomplished by the use of a conductive potting material 90, as shown in FIG. 7. It is unnecessary to perform a separate operation of removing the jacket layers 32, 34 from the cable 10 to expose the exterior surface 28 of the shield, and the jacket 30 and shield 22 may thus be removed from the primary conductors 12, 14 and their associated layers of dielectric material in a single operation, thus effecting significant savings of labor and time. Thus, several cables 10 according to the present invention may more easily be connected as to the connector 92 shown in FIG. 7, where the primary conductors 12, 14 are electrically connected to connector terminals 94 by conventional methods. Thereafter the junctions between the primary conductors 12, 14 and connector terminals 94 are covered by an insulating layer of a non-conductive potting material 96. Finally, electrical connection is made to the shield conductor 22 by the use of the conductive potting material 90 which comes into physical contact with the exposed conductive surfaces 28 of the shield 22.

Various materials could be used as the conductive potting material 90, such as conductive epoxy adhesives, conductive thermo-setting plastics, conductive thermoplastic resins, and even conductive metal alloys which have very low melting points. A satisfactory conductive potting material for use in connecting large numbers of cables such as the cable 10 in order to dissipate static charges developed by friction between a dielectric cooling fluid and the dielectric material of the jacket 30 is a silver fill epoxy available from Epoxy Pax of Costa Mesa, Calif. under the part number EP-1922-78. Such a material has a bulk resistivity of $10^{-6}$ Ohm-cm. A drain conductor 98 may also be embedded in the potting material 90 and connected therefrom to a common or ground potential to carry away accumulated electrical charges in order to prevent the voltage from increasing to the point where a substantial and potentially harmful discharge might result from the breakdown of the dielectric material within the cable 10.

Particularly in the use of a cable such as the coaxial cable 70 where the shield conductor 76 is used to carry signal information, it is highly desirable to use a potting material 90 which has a very low resistivity for effecting electrical connection to the shield conductor.

In other locations where a shield conductor of a cable such as the cable 10 is not being used to carry signal information, but is acting primarily as only an electrostatic shield, a graphite conductive epoxy having a higher resistivity, on the order of 50 Ohm-cm is appropriate. Such a conductive epoxy potting material is available from the Master Bond Company of Hackensack, N.J. under the part number EP75.

In some applications where the shield layer of a cable according to the invention is being used as an electrostatic drain an infinite resistance between the primary conductors, such as the conductors 12 and 14 of the cable 10, is acceptable at a location corresponding to the connector 92. In such situations it would be satisfactory, and would give an additional savings of time and labor, to connect the shield and protect the connections at the terminals 94 by using a single potting material in place of the two layers of potting material 90 and 96. Such a single potting material should have a resistivity low enough for the material to act as a satisfactory drain for the shield conductor of the cable, but high enough to maintain an acceptable resistance between the several primary conductors terminated at a given connector.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A cable for carrying electrical signals, comprising:

(a) at least one elongate conductor;

(b) a dielectric layer extending longitudinally of said cable and surrounding said conductor;

(c) a shield layer of electrically conductive material extending longitudinally of said cable and surrounding said dielectric layer; and (d) a fluid-permeable jacket surrounding said shield layer and providing mechanical support therefor, said jacket including at least one elongate member wrapped helically about said shield layer and defining a plurality of helical turns, adjacent ones of said helical turns being spaced apart from each other longitudinally of said cable so as to expose portions of said shield layer therebetween.

2. The cable of claim 1 wherein said electrical shield layer is of a conductive foil adhesively bonded to a dielectric film, in the form of an elongate tape wrapped helically about said conductor and said dielectric layer with said foil facing inward and said dielectric film outwardly disposed.

3. The cable of claim 1 wherein said electrical shield layer is of a conductive foil adhesively bonded to a dielectric film, in the form of an elongate tape wrapped helically about said conductor and said dielectric layer with said foil facing outward and said dielectric film inwardly disposed.

4. The cable of claim 1, said jacket including a pair of said elongate members each in the form of a tape of a flexible dielectric material, said elongate members being wrapped in opposite helical directions each defining respective helical turns thereof, and adjacent ones of the helical turns of each said elongate member being spaced apart longitudinally of said cable.

5. The cable of claim 1, including a twisted plurality of said elongate conductors each having a respective insulative layer and said electrical shield layer surrounding both of said conductors and their associated insulative layers.

6. An elongate cable for carrying electrical signals, comprising:

(a) at least two elongate electrical conductors, including a twisted pair of conductors extending generally parallel with each other and longitudinally of said cable;

(b) at least each of said twisted pair of said electrical conductors having a layer of a dielectric material associated therewith;

(c) a shield conductor surrounding said at least two conductors and said dielectric material; and (d) a fluid-permeable jacket surrounding said electrical conductors and said layer of said dielectric material and providing mechanical support thereto, said jacket including at least one elongate member wrapped in helical turns about said electrical conductors, adjacent ones of said helical turns of said elongate member being spaced apart from each other.

7. An elongate cable for carrying electrical signals, comprising:

(a) at least two elongate electrical conductors, including a twisted pair of conductors extending generally parallel with each other and longitudinally of said cable;

(b) at least said twisted pair of said electrical conductors having a layer of a dielectric material associated therewith; and (c) a fluid-permeable jacket surrounding said electrical conductors and said layer of said dielectric material and providing mechanical support thereto, said jacket including a pair of elongate members wrapped in opposing helical turns about said electrical conductors, adjacent ones of said helical turns of each of said elongate members being spaced apart from each other.

8. A method of making an electrical connection, comprising:

(a) providing a signal transmission line including at least one elongate conductor, a dielectric layer extending longitudinally of and surrounding said conductor, a shield layer of electrically conductive material extending longitudinally of and surrounding said dielectric layer and facing outwardly therefrom, and a fluid-permeable jacket surrounding said shield layer and including at least one elongate member of a dielectric material wrapped helically about said shield layer and defining a plurality of helical turns, adjacent ones of said helical turns being spaced apart from each other and exposing portions of said shield layer therebetween; and (b) surrounding a portion of said jacket with an electrically conductive potting material and bringing said potting material into electrical contact with at least some of said portions of said shield layer exposed between said adjacent ones of said helical turns.

9. The method of claim 8 including the further steps of exposing a portion of said elongate conductor and its dielectric layer to extend longitudinally beyond said shield layer and said jacket and electrically connecting said elongate conductor to a terminal.

10. The method of claim 8, including the step of preventing said potting material from electrically contacting said elongate conductor.

* * * * *